United States Patent [19]

Kitchen

[11] Patent Number: 4,805,883

[45] Date of Patent: Feb. 21, 1989

[54] BOX SPRING ASSEMBLY WITH A GRID STRUCTURE FORMED OF BOTH BASIC AND SPRING WIRE

[75] Inventor: John P. Kitchen, Georgetown, Ky.

[73] Assignee: Hoover Group, Inc., Roswell, Ga.

[21] Appl. No.: 83,353

[22] Filed: Aug. 10, 1987

[51] Int. Cl.[4] ..... F16F 3/00; A47C 23/02; A47C 23/04

[52] U.S. Cl. ..... 267/103; 5/259 B; 5/260; 5/275; 267/105

[58] Field of Search ..... 267/80, 83, 95, 97, 267/98, 103, 105, 110, 91, 111; 5/259 B, 259 R, 260, 275, 276, 277, 247, 255, 267, 476

[56] References Cited

U.S. PATENT DOCUMENTS

| | | | |
|---|---|---|---|
| 1,789,154 | 1/1931 | Owen | 5/259 B X |
| 3,270,354 | 9/1966 | Ciampa et al. | 5/275 |
| 4,253,208 | 3/1981 | Hancock et al. | 5/267 X |

*Primary Examiner*—Andres Kashnikow
*Assistant Examiner*—Robert J. Oberleitner
*Attorney, Agent, or Firm*—Harness, Dickey & Pierce

[57] ABSTRACT

A box spring assembly consisting of a generally horizontal frame and a generally horizontal wire grid disposed a predetermined distance above the frame, and a plurality of grid support springs arranged between and secured to the grid and the frame so as to yieldably support the grid on the frame. Auxiliary grid crosswires formed of spring wire are incorporated in the grid to strengthen the grid and distribute bedding loads between the support springs.

5 Claims, 4 Drawing Sheets

FIG. 5
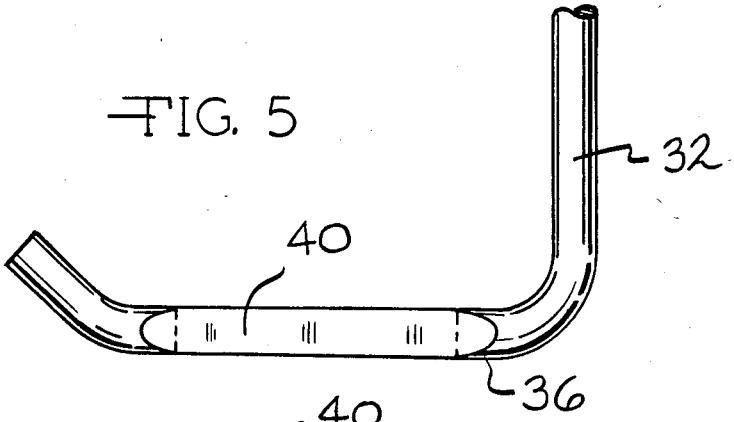
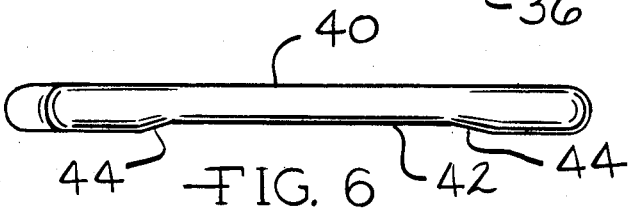
FIG. 6
FIG. 7
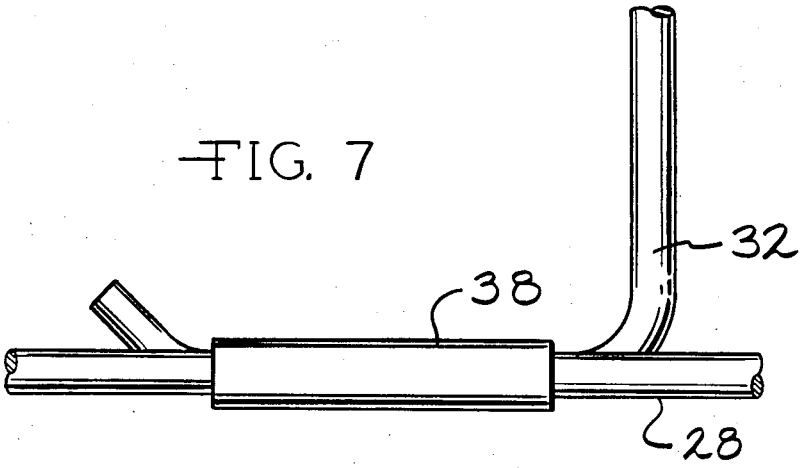
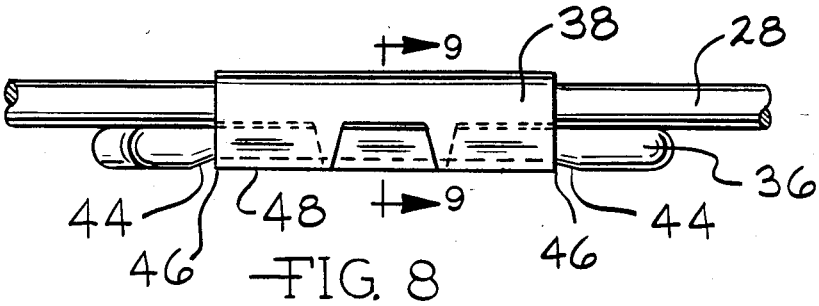
FIG. 8
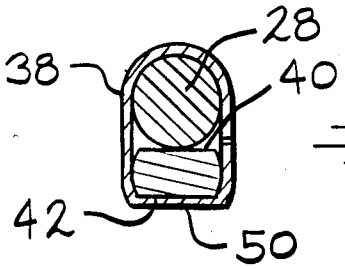
FIG. 9

BOX SPRING ASSEMBLY WITH A GRID STRUCTURE FORMED OF BOTH BASIC AND SPRING WIRE

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U S. Pat. No. 3,286,281. Subsequently issued patents disclosing the same general type of box spring assembly are : U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; and 4,470,584. Box spring assemblies of the general type shown in the above list of patents, all of which are owned by the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960, 3,833,948; 3,835,485; 3,869,740; 3,990,121; and 4,000,531.

The present invention provides a box spring assembly which utilizes a particular wire grid structure and supporting spring modules. Each spring module has a pair of vertically yieldable end portions that terminate at their upper ends in torsion bars connected by a connecting bar. The upper end torsion bars and connecting bars are clipped into the grid so as to insure a desired transmission of bedding loads over wide areas of the grid that are supported on a large number of spring modules.

This avoids localized heavy stressing of basic wire sections of the grid which are easily deformed and also helps to avoid overloading of individual spring modules, thereby insuring a prolonged service life for the box spring assembly. In addition, user comfort is enhanced by virtue of the coaction of grid and springs in reacting to bedding loads.

SUMMARY OF THE INVENTION

The box spring assembly of this invention consists of a horizontal rectangular frame having corners add a generally horizontal mattress support grid disposed a predetermined distance above the frame. The frame has a pair of side rails having ends and spaced cross rails supported on and extending between the ends of the side rails and predetermined intermediate portions of the side rails between the ends.

The grid includes a plurality of straight wires arranged criss-cross fashion and formed of welded basic wire, some of the wires extending the length of the frame and other wires extending crosswise of the frame and a border wire formed of spring wire and having corner portions located above and substantially vertically aligned with the corners of the frame. The border wire has side sections and cross wire sections extending between the ends of the side sections. A plurality of grid support springs are arranged between the grid and the frame so as to yieldably support the grid on the frame, the support springs being formed of spring wire.

Each of the support springs is a formed wire spring having vertically yieldable end portions that include torsion bars that are subjected to torsional stresses when the box spring assembly is subjected to bedding loads. The yieldable end portions of each of the support springs are connected at their upper ends by a connecting wire that is clipped to one of the grid wires.

The grid also includes a plurality of cross wires that are formed of spring wire and are of a larger diameter than the criss-cross basic wires in the grid. These spring wire grid members are disposed in a side-by-side relation with crosswise extending basic wires in the grid and are connected to these basic wires by conventional clips which encircle the side-by-side wires. At their ends, the spring wire grid members are offset downwardly ad have transversely extending end portions that are positioned beneath and in a side-by-side relation with the border wire side sections. Conventional clips secure the spring cross wire end portions to the border wire side sections.

The lengthwise basic wires in the grid are similarly attached to the border wire end sections by clips to assure a firm support of the grid on the border wire.

The result is a formed wire box spring assembly in which the crosswise spring wires reinforce the load carrying grid and facilitate the distribution of bedding loads onto the various support springs to thereby avoid stress concentration failures in both the grid and the support springs. A box spring having improved performance characteristics and prolonged service life characteristics is thus provided.

Further objects, features and advantages of this invention will become apparent from a consideration of the following description, the appended claims, and the accompanying drawing in which:

FIG. 5 is a fragmentary plan view of the end portion of a spring wire cross wire in the grid of this invention;

FIG. 6 is an end view of the cross wire end portion shown in FIG. 5;

FIG. 7 is a fragmentary plan view of the cross wire end portion illustrated in FIG. 5 and 6 in assembly relation with a border wire and a connecting clip;

FIG. 8 is an end view of the structure shown in FIG. 7; and

FIG. 9 is a tranverse sectional view of the clip, cross wire and border wire structure illustrated in FIG. 8, as seen from substantially the line 9—9 in FIG. 8.

Figure 1:
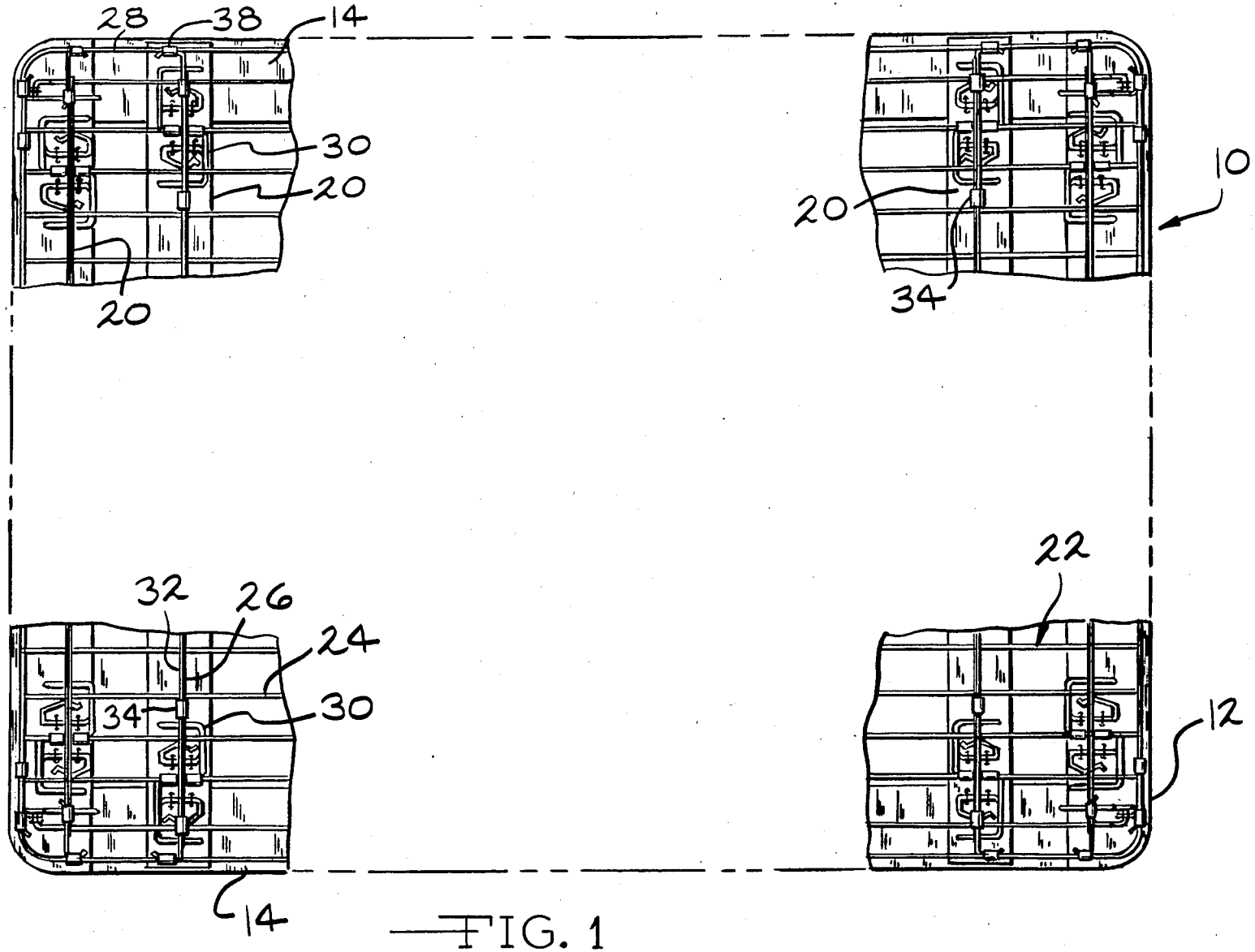
FIG. 1 is a plan view of the box spring assembly of this invention with parts broken away.

The box spring assembly 10 is illustrated in FIG. 1 as consisting of a rectangular, horizontally disposed frame 12 having wooden side rails 14 and cross rails 20 which are secured to and extend between the side rails 14.

The box spring assembly 10 also includes a horizontally disposed welded wire grid or deck 22 which consists of a plurality of straight wires that are arranged in criss-cross fashion, some o the wires extending lengthwise of the frame 12, referred to hereinafter as "lengthwise wires" 24, and some of the wires extending crosswise of the frame 12, hereinafter referred to as "crosswise wires 26". The wire grid 22 also includes a rectangular border wire 28 which is secured to the wires 24 and 26 which are in turn welded together at their junctures. The border wire 28 is of substantially the same size and shape as frame 12. A plurality of spring modules, or support springs, 30 support the grid 22 on the frame 12.

The border wire 28 and the spring modules 30 are preferrably formed of nine gauge spring wire, a high carbon heat treated steel which has the "springiness" characteristic necessary to enable a wire to deflect under load and then return to its original position when the load is released. Spring wire usually has a carbon content in the range of 0.6–0.9 percent, and it is a percentage of carbon in this general range that is referred to herein as "high carbon".

The grid wires 24 and 26 are formed of basic wire, a low carbon, non-heat treated steel that lacks the "springiness" characteristic of spring wire and is thus less expensive but readily weldable. Basic wire usually contains carbon in the range of 0.08–0.1 percent and a carbon content generally within this range is what is referred to as "low carbon".

The welded wire grid 22 forms a mattress support deck disposed in a horizontal plane at a predetermined distance above the frame 12. A plurality of support springs 30, of the type shown in U.S Pat. No. 4,470,584, arranged in a predetermined pattern on frame 12, which pattern can vary depending upon the size of the spring assembly 10 and other manufacturing and support characteristics considerations, yieldably support the grid 22 in this position above the frame 12 for movement toward the frame to accommodate bedding loads. Corner springs 31 assist the springs 30 and provide firm support for the corners of the grid 22.

Figure 4:
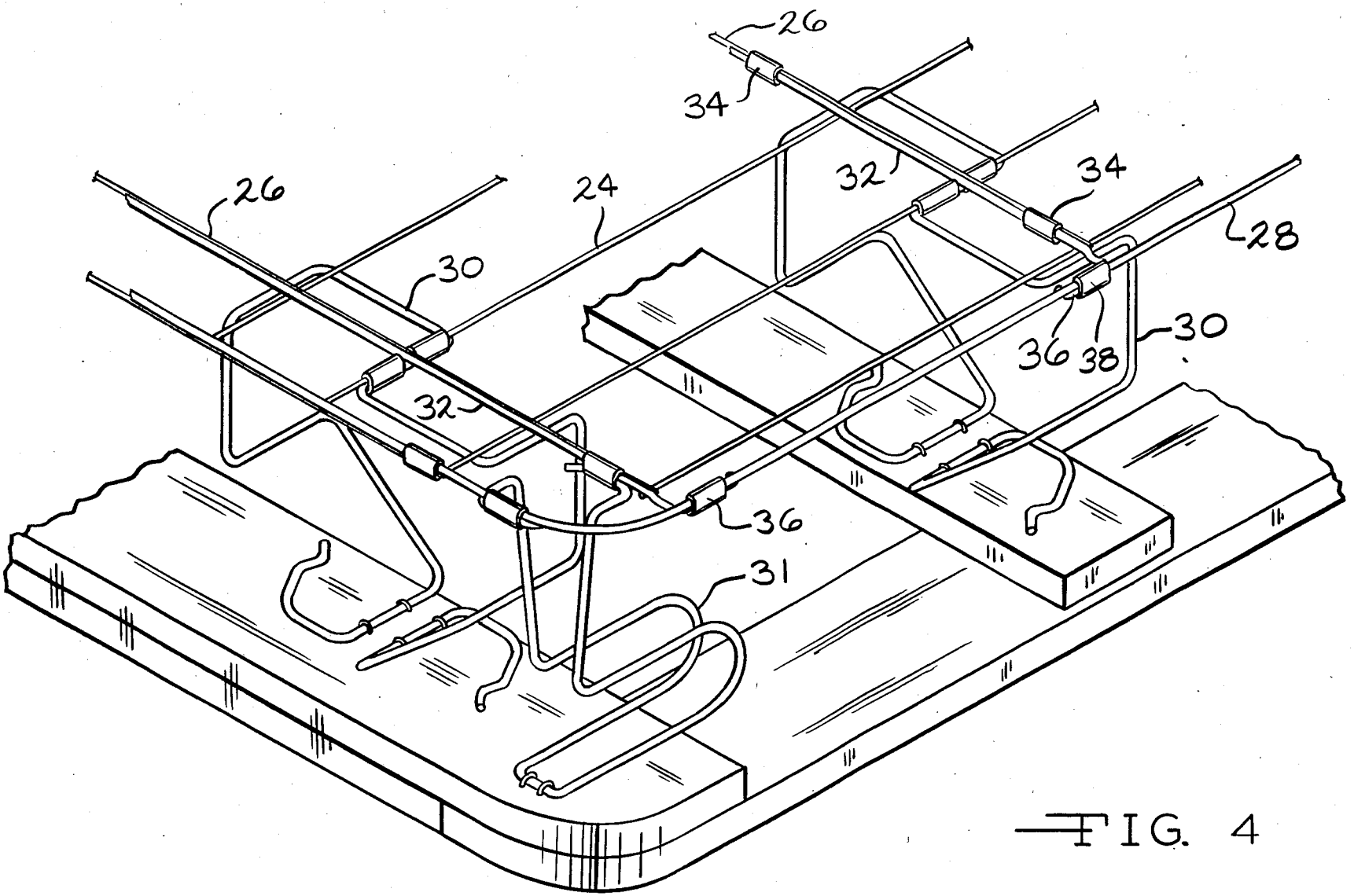
FIG. 4 is a fragmentary perspective view of a portion of the box spring assembly of this invention.

The grid 22 also includes spring wire cross wire members 32 (FIG. 4) which are larger in diameter than the basic wires 26 and are arranged in a side-by-side relation with the wires 26. The wires 32 are also preferably of nine gauge wire and are secured by clips 34 to the cross wires 26. At their ends, the crosswires 32 have transversely extending connecting sections 36 which are positioned below and in a side-by-side relation with the border wire 28. Clips 38 secure the connecting sections 36 to the border wire 28.

As shown in FIG. 5, the top side of the connecting section 36 of each cross wire 32 is flattened as indicated at 40. The underside of the connecting section 36 is provided with a similar flat surface 42 which is indented and bounded at its ends by downwardly inclined surfaces 44.

The clip 38 is of a wrap around type and is of a length corresponding substantially to the lengths of the flattened surfaces 40 and 42. As a result, the ends 46 of the clip 38 are engagable with the inclined surfaces 44 on the underside of the connecting section 36 to prevent the clip 38 from sliding lengthwise of the border wire 28. As shown in FIG. 8, the underside 48 of the clip 38 is substantially on a level with the underside of the connecting section 36. As shown in FIG. 9, the clip 38 encircles the border wire 28 and the cross wire connecting section 36 so as to maintain the flattened cross wire surface 42 in firm engagement with the underside of the border wire 28. The bottom side 50 of the clip 38 is in surface to surface engagement with the flattened surface 42 on the underside of the cross wire connecting section 36 so as to positively prevent rotation of the clip 38 about the border wire 28 and the cross wire connecting section 36. This precludes the relative movement of the clipped sections 28 and 36 to thereby achieve a firmly assembled grid structure which will not work loose during use and in which noise of relatively moving wires is avoided.

Figure 3:
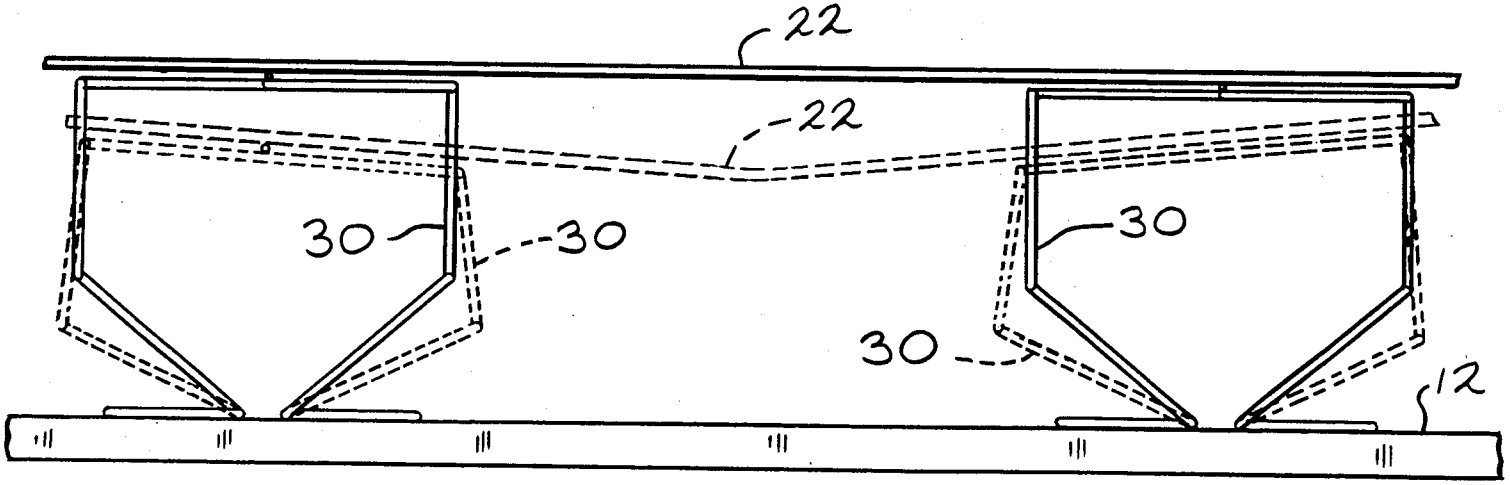
FIG. 3 is a view like FIG. 2 of the box spring assembly of this invention.

The result is a box spring assembly in which the grid 22 is reinforced by the spring wires 32 which function to transfer loads between adjacent support spring modules 30, as shown in FIG. 3, and prevent the basic wires 26 in the grid from becoming deformed as a result of being stressed beyond their elastic limit.

Figure 2:
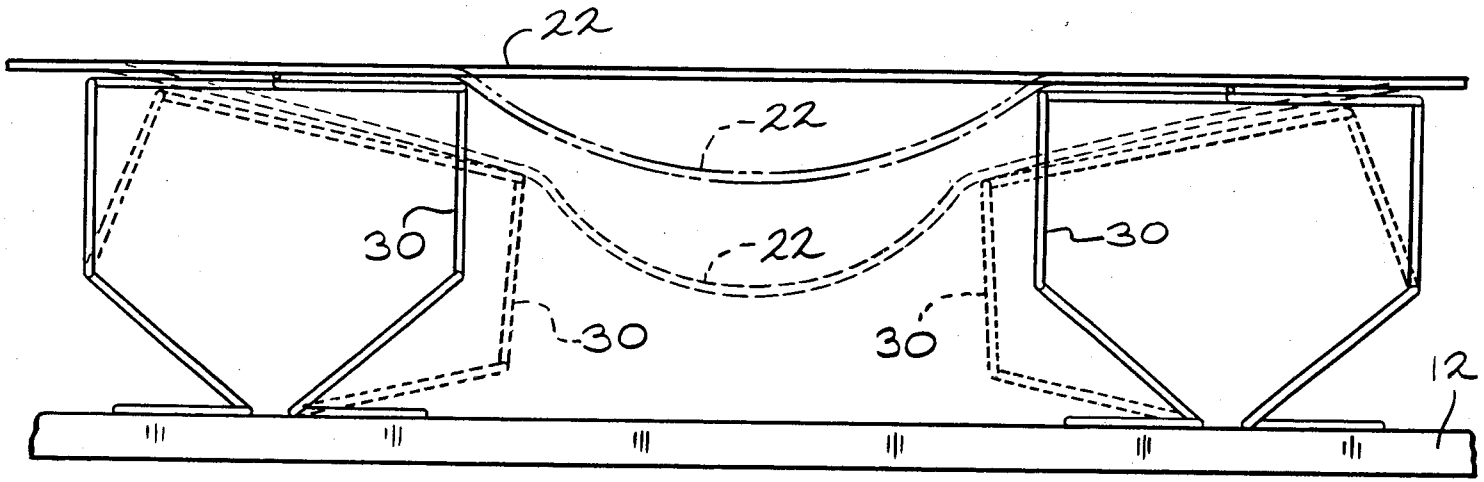
PRIOR ART FIG. 2
FIG. 2 is an enlarged transverse sectional view of a portion of a prior art box spring assembly illustrating deflection due to bedding load.

The contrast between a prior art box spring assembly in which the grid 22 is not provided with the spring wire reinforcing is illustrated in FIG. 2 wherein the grid becomes of a generally "bucket" shape between the support spring modules 30, causing the modules to be tipped sideways and thereby causing the entire box spring assembly to take a "set". This results in the box spring assembly being unable to resume its unstressed condition following removal of the load.

In FIG. 3, the result of loading of the box spring assembly of this invention is illustrated in which it is shown that the spring modules 30 deflect in a more straight line up and down nature and the grid 22 maintains the substantially horizontal disposition that it is in when unstressed. The result is a box spring assembly 10 in which the auxiliary grid wires 32 reinforce the basic wires 26 in the grid 22 and distribute the bedding loads onto the various support springs 30. This avoids stress concentration failures in both the grid 22 and the springs 30 and also avoids the deformations in the grid 22 shown in the prior art assembly shown in FIG. 2.

What is claimed is:

1. A box spring assembly comprising a generally horizontal frame having a generally horizontal welded wire grid disposed a predetermined distance above said frame, said grid including a plurality of straight wires arranged criss-cross fashion, some of said wires extending lengthwise of said frame and others of said wires extending crosswise of said frame, and a border wire supporting said lengthwise and crosswise wires, said border wire being of generally rectangular shape having side sections and end sections; a plurality of grid support springs arranged between and secured to said grid and said frame so as to yieldably support said grid on said frame, and auxiliary grid wires formed of spring wire connected to and extending crosswise of said border wire, and means connecting at least one of said auxiliary grid wires intermediate its ends to one of said grid cross wires and at its ends to said border wire side sections.

2. The box spring assembly according to claim 1 wherein said means connecting said one auxiliary grid wire to said one cross wire are clips, said auxiliary grid wire and said one cross wire being arranged side-by-side.

3. The box spring assembly according to claim 2 wherein said auxiliary grid wires are straight between said border wire side sections.

4. The box spring assembly according to claim 3 further including transversely extending end sections on said one auxiliary grid wire arranged in side-by-side relation with said border wire side sections and clips encircling and securing said side-by-side sections together.

5. The box spring assembly according to claim 4 wherein said end sections of said auxiliary grid wire have flattened surfaces engaged with said clips to preclude relative movement of said clips and said grid wires.

* * * * *